United States Patent [19]

Tobler

[11] Patent Number: 4,763,950

[45] Date of Patent: Aug. 16, 1988

[54] TILTING CHAIR, ESPECIALLY OFFICE CHAIR

[75] Inventor: Peter Tobler, Rheineck, Switzerland

[73] Assignee: Provenda Marketing AG, Herisau, Switzerland

[21] Appl. No.: 946,192

[22] Filed: Dec. 23, 1986

[30] Foreign Application Priority Data

Jan. 7, 1986 [CH] Switzerland ..... 20/86

[51] Int. Cl.[4] ..... A47C 1/032

[52] U.S. Cl. ..... 297/301; 297/304; 297/306; 297/316

[58] Field of Search ..... 297/300, 301, 304, 305, 297/306, 316

[56] References Cited

U.S. PATENT DOCUMENTS

| | | | |
|---|---|---|---|
| 1,359,145 | 11/1920 | Atwood | 297/304 |
| 1,368,469 | 2/1921 | Atwood | 297/304 |
| 2,139,028 | 12/1938 | Mensendicck et al. | 297/284 |
| 2,321,385 | 6/1943 | Herold | 297/305 X |
| 4,099,775 | 7/1978 | Mizelle . | |
| 4,629,249 | 12/1986 | Yamaguchi | 297/300 |
| 4,682,814 | 7/1987 | Hansen . | |

FOREIGN PATENT DOCUMENTS

| | | | |
|---|---|---|---|
| 001846 | 5/1979 | European Pat. Off. . | |
| 2733322 | 8/1980 | Fed. Rep. of Germany . | |
| 3316533 | 11/1984 | Fed. Rep. of Germany . | |
| 645280 | 10/1928 | France | 297/301 |
| 1196603 | 11/1959 | France . | |

*Primary Examiner*—Kenneth J. Dorner
*Assistant Examiner*—Peter R. Brown
*Attorney, Agent, or Firm*—Frishauf, Holtz, Goodman & Woodward

[57] ABSTRACT

To permit backward rocking of the back or back-and-seat of a chair, independently of the previously tilted-back position of the chair, a comfort position memory structure is provided which includes a manually adjustable variable stop structure formed by a cam curve (37) with a serrated or toothed surface, engaged by a stop element (41) coupled to the seat (17, 19). The cam (37) is manually rotatable, by being secured to an externally user-accessible adjustment segment (45). To set a predetermined tilted position, the user tilts back on the chair, and then permits the chair to tilt forward to a comfortable position, and then rotates the manually engageable segment (45) until a tooth (39) of the cam disk (37) is engaged by the stop (41). A spring (32) biasses the chair forwardly and against the stop, unless tilted back by the user.

4 Claims, 3 Drawing Sheets

TILTING CHAIR, ESPECIALLY OFFICE CHAIR

REFERENCE TO RELATED PUBLICATIONS

European Published Patent Application No. EP-A-0 001 846, FLUM. German Patent No. 27 33 322.

The present invention relates to a chair, and more particularly to a tilting chair in which a spring is provided against which the user can tilt the seat and/or the chair back.

BACKGROUND

Tilting chairs usually contain some mechanism which provides a lock or stop, limiting the extent of tilting of the chair seat surface and/or of the chair back, together or independently, with respect to a rest position. European Published Patent Application No. EP-A-0 001 846, Flum, describes a tilting chair which permits blocking tilting of the chair back in various positions. The construction permits fine adjustment. When the chair back has been set to a certain tilted position, it cannot be tilted anymore forwardly or backwardly; in other words, the tilt or inclination of the chair back is fixed. If the user wishes to rock in the chair, the blocking or locking mechanism can be unlocked. If the user, then, rises from the chair, the back will be moved under spring pressure to its foremost or rest position. To reset a desirable angle of the chair back, then, requires first moving the chair back to the tilted position desired, and then, again, locking or blocking the chair back in that particular position.

Constant resetting of the predetermined and usually most comfortable inclination or tilt of the chair back is undesirable and annoying to the user, particularly if an initial adjustment by the user does not result in a comfortable tilt or inclination of the back, so that readjustment is necessary—which readjustment is lost as soon as the user wishes to rock on the chair.

The chair described in the European Patent Application Flum locks the inclination of the back in position by bolts which engage in an apertured plate. It is also possible to lock the inclination of the back in position by blocking a gas spring—see German Patent No. 27 33 322. Gas springs are widely used in connection with chair construction, since they can be easily employed not only as springs but, additionally, as a stepless, continuously variable positioning element, in that the position of the sprung structure can be determined by blocking the gas spring. The gas spring includes a valve and, by closing the valve, the spring can be hydraulically or pneumatically locked or unlocked in any specific position. The chair described in German Patent No. 27 33 322 thus permits placing the chair back in any desired position. Upon unlocking of the gas spring, rocking movement of the chair is possible. As soon as the user leaves the chair, however, for example rises, the now unlocked gas spring will move the back in its foremost or rest position so that, if the user wishes to use the chair again in a comfortable position, the gas spring must first be compressed and then locked in position, with possible adjustment if a comfortable position is not immediately found. The result, as far as the user is concerned, is similar to that of the chair described in the European Patent Application Flum.

THE INVENTION

It is an object to provide a rocking or tilting chair in which a user can rock on the chair while setting the inclination of a chair component to which inclination the respectively set component will always return; in other words, it is an object to provide a chair which includes a "comfort position memory" and which, nevertheless, is simple and hence inexpensive to construct.

Briefly, the chair has the usual base support structure and a seat element and a back element, which are coupled together, the back element being rearwardly tiltably movable. A spring is provided to bias the back element in a forward position. In accordance with a feature of the invention, a manually adjustable variable stop structure is provided, which is coupled to the back element or to the seat element, or to both; it is is arranged to inhibit forward tilting movement of the back element under force of the spring. Thus, a comfort position memory is provided, which retains the forward position of the back element at a predetermined tilt, but permits backward tilting against the force of the spring.

The chair has the advantage that the user can adjust the tilt or inclination of the chair back, for example, in accordance with a desired and comfortable position but still can rock backwardly, if desired. If rocking is no longer desired, or if the user leaves the chair, the chair will not return to a rest position but, rather, to the previously adjusted comfort position. If the user wishes to change the comfort position, the user may do so at any time; or if someome else uses the chair, a newly adjusted comfort position can be readily reset.

The invention, in part, relates to an analysis of use of chairs, and the problems associated therewith, and, in part, to a recognition of the problem of retaining a predetermined comfort position in a memory in the chair regardless of whether the chair is fixed with respect to a support surface, such as a floor, or whether it can be tilted or rocked. In spite of the numerous chair constructions, applicant is not aware of any chair where , in one structure which is both simple and reliable, a predetermined tilt position can be controlled or commanded and, so to speak, placed in a memory, while still permitting rocking and return to the commanded and memory position at all times rather than to a rest or position determined for all chairs by the manufacturer and, frequently, uncomfortable for all users.

In accordance with a feature of the invention, and to provide a simple, reliable and inexpensive construction, a movable stop is located on the chair which, preferably, is positioned between a support element for the chair back and for the chair seat. The resulting construction is particularly simple. In a chair in which the seat and the back move together, that is, in which the seat surface and back surface can rock or tilt conjointly, the stop arrangement can also be placed between the chair support, usually a central post, and the seat surface.

DRAWINGS

DETAILED DESCRIPTION

Figure 1:
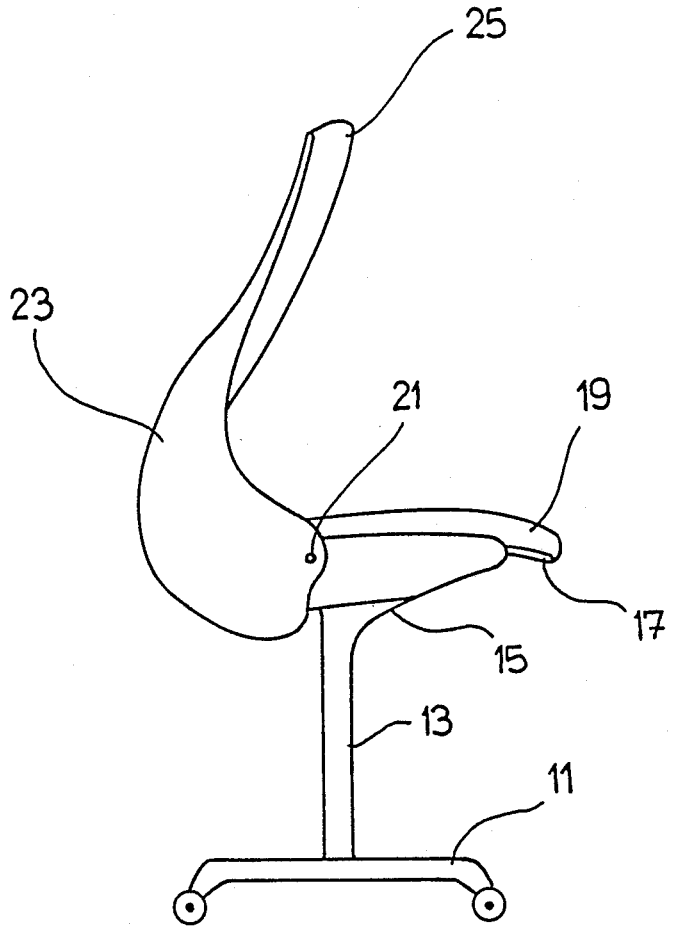
FIG. 1 is a schematic view of a tilting office chair with the chair back in forward position.

The chair shown in FIG. 1 has the usual support spiders 11 which support a vertical post 13. A seat base 15 is coupled to the post 13 and retains thereon a seat plate 17 having an upholstery 19 thereon. A back carrier 23, pivotably connected at or pivot tilt axis 21, is coupled to the seat plate 17. The back 23 has a back padding or upholstery 25.

The chair is known as a synchronized chair, that is, upon tilting or rocking the back 25, seat 17 likewise will incline. The inclination of the seat is about half as much as that of the back 23. Tilt axis 21 is placed close to the center of seat 17, and close to alignment with post 13 (see FIG. 2).

Figure 2:
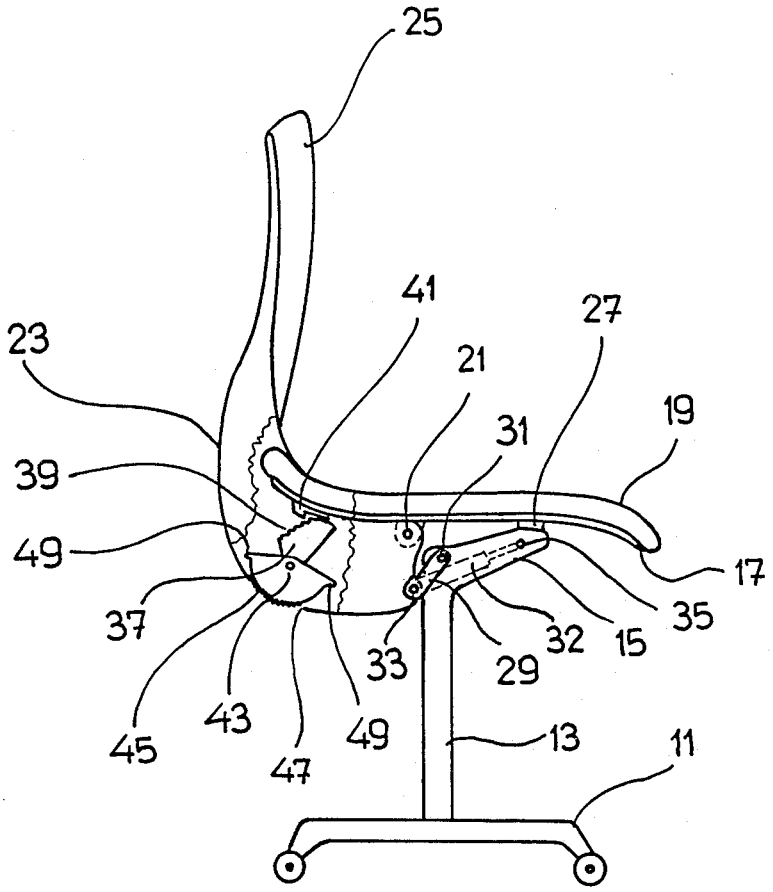
FIG. 2 is the office chair of FIG. 1, with a chair back shell partly broken away, to show a stop arrangement for tilting the chair back element backwardly.

The seat plate 17—see FIG. 2—is coupled to an elastic connecting plate 27 and tiltably secured to the seat carrier 15 by the connecting plate 27. The seat plate 17 and back 23 are coupled at the tilt axis 21, as previously referred to. The back element 23 can be constructed, for example as shown, in shell construction, that is, being laterally molded about the seat. A connecting lever 29 is located on either side of the back element 23 to form a link connection between the seat base 15 and the back element 23—see FIG. 2. The link 29 is pivoted to the back at pivot axis 33 and to the seat carrier 15 at pivot axis 31. A spring 32 is provided. Preferably, the spring 32 is a gas spring which is pivotably connected to the pivot 33. Pivot 33, for example, may be a cross bar. The gas spring 32, further, is pivotably connected to the seat support 15 at a pivot axis 35. When unlocked, the spring provides a force which has the tendency to press the back 23 into a forwardly tilted position, as best seen in FIG. 1. The spring can be blocked or unblocked by a suitable operating lever—not shown—which is standard in gas spring constructions.

The gas spring 32, thus, and as is customary in chairs, has a dual function: For one, it has the sole function of a spring, providing a biassing force, in the present case, to tilt the chair back 23 forwardly; aqnd for another, to form a block or locking element to prevent movement of the chair back after the spring has been set in a predetermined position. The chair back 23, when the spring is locked, can be tilted or rocked neither forwardly nor backwardly. Rather than using a gas spring 32, a mechanical spring, such as a spiral spring can be used; spiral springs, however, cannot be normally locked in a position. It would be possible, of course, to add an additional mechanical rocking or tilting lock, as described, for example, in the European Patent Application Flum No. 0 001 846.

In accordance with the present invention, and forming a substantial advantage thereof, a tilting or rocking lock acting in both forward as well as rearward direction is not needed since a simple lock with respect to forward direction, only, is effective and provides for a comfort position memory while still permitting the user to rock backwardly, if so desired, while also using the "comfort position", for example, for writing at a desk.

Figure 3:
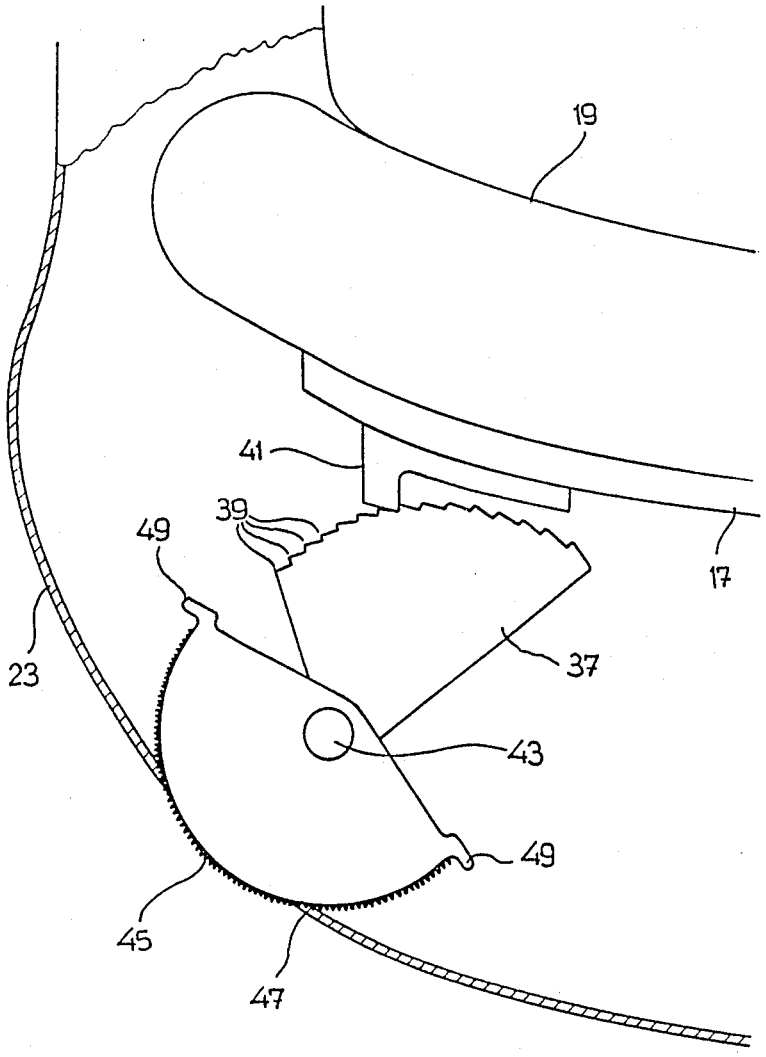
FIG. 3 is a fragmentary enlarged view illustrating the chair back arresting mechanism.

The simple comfort position memory, in accordance with the present invention, is best seen in FIG. 3. A stop element 37 is located between the back element 23 and the seat plate element 17. It would also be possible to locate the stop element 37 between the seat plate element 37 and the seat base or support 15, as shown in detail in FIG. 4. The stop element 17 is adjustable. As shown—see FIG. 3—it is a serrated curved cam disk segment having a plurality of engagement teeth 39. The engagement teeth 39 can be engaged by a stop pawl 41 secured to the seat plate 17. The position at which the stop pawl 41 engages a selected tooth of the segmental cam disk 37 is controlled by moving an adjustment wheel 45 coupled to the cam disk 37. The cam disk 37 and the adjustment element 45 which is a wheel segment are both rotatable about a shaft 43. The wheel segment 45, preferbly formed with an outer serrated or knurled surface for ease of manual engagement and serraged segment 37 are secured together, for example by being welded together. Thus, the adjustment or positioning element 45 is securely coupled to the ratchet segment 37. It should be noted that the teeth 39 at the circumference of the ratchet segment 37 are not located on a surface which is concentric with the pivot axis of pivot 43 but, rather, are eccentric or located on a curve such that engagement of the stop element 41 with the selected tooth will be at respectively different tilted positions of the back element 23.

The adjustment or positioning wheel segment 45 is externally accessible by extending through an aperture 47 formed in the back element 23. The adjustment segment 45, at either side, has a stop projection 49 which determines the end positions of the wheel segment 45 and hence of serrated or ratchet segment 37. In the embodiment shown, the axis of rotation, 43 is retained in the structure of the back element 23. The axis of pivot 43 for the cam disk segment 37, and the adjustment wheel 45 therefor, is spaced from the tilt axis 21 (see FIG. 2) between the seat plate 17 and the back 23, 25. Preferably,the back element 23, and forming the shell, is made as an aluminum injection casting.

Operation: to place the back 23 in a desired position, the user sits on the chair and presses against the upholstered surface 25 of the back 23 until he has found the desired position. The adjustment wheel segment 45 is then rotated in counterclockwise direction until a tooth 39 engages with the stop pawl 41. This determines the desired forward position of the back element 23. The user can rock backwardly, since the stop pawl 41 will then travel freely over the teeth 39 farther below—see FIG. 3—. When the user moves forward the stop 41 always will stop the back 23 in the desired position.

If the user wishes to change the position, it is only necessary to rock backwardly; this lifts off the stop pawl 41 from the respective tooth in the ratchet element 37, which can be referred to as a serrated cam disk. The positioning wheel can then, freely, rotate the cam disk 37 to a different position.

The adjustment wheel 45 is retained in position in any suitable manner, for example by friction or a friction disk which is pressed axially against a counter element by a spring, or by a spring-loaded engagement snap, a ball-and-socket arrangement or the like.

The structure of the present invention is particularly suitable when used in synchronously operating chairs in which relative movement between the back element and the seat element, or between the seat element and the seat support 15 can be obtained, resulting in a simple, sturdy and reliable, yet inexpensive construction; the invention is not limited to such chairs, however.

Various changes and modifications may be made, for example rather than using a rotatable cam disk 37, a shiftable wedge with a serrated surface having the teeth 39 engageable by a stop pawl 41 may be used.

Serrating the cam or curved disk 37, as shown specifically in FIG. 3, results in an element which is easily made and provides a clearly defined position of the back element of the chair.

It is a simple matter to couple the cam segment 37 and the adjustment segment 45 together and permitting the adjustment segment 45 to extend through a suitable opening or slit 47 in the back element structure 23. The user can easily reach such an adjustment segment. It is only necessary to sit in the chair, rock backwardly, and then rotate the segment 45 until it cannot be rotated any further—indicating that the stop pawl 41 has engaged with a tooth 39. This, then, sets the desired forward position of the back structure 23 until the same user, or someone else, wishes to change the setting,which can be accomplished easily by merely rocking backwardly a little and resetting the position by again rotating the segment 45. Placing stop elements 49 at the ends of segment 45 also determines the end position of the cam curve 37, resulting in a simple construction and a reliable setting of the terminal positions for the back, with a minimum number of parts.

Use of a gas spring is particularly preferred since the spring against which the back can be tipped or rocked can be locked in any desired position. The combination of a gas spring with the structure of the present invention thus has the advantage that the chair becomes universally adjustable and lockable—by the gas spring in any specific position for the back, without being capable of rocking backwardly. The gas spring will block movement in both directions. Alternatively, the gas spring can be set for a predetermined position, then wheel 45 rotated to engage, and the gas spring unlocked. The present invention, thus, permits a predetermined position of the back in a working position, yet permits rocking backwardly of the back, if desired. The combination of the stop structure and adjustment structure of the present invention with the gas spring, thus permits universal adjustment and, additionally, selective locking or locking only with respect to a foward position. The gas spring, of course, acts not only as a locking element but, additionally, as a bias force or spring element when the user has unlocked the gas spring and wishes to rock backwardly, for example by tilting the seat 17 about the pivot points 35-31-33 (FIG. 2) and rocking backwardly.

I claim:

1. Tilting chair, especially office chair, having a base support (13, 15);

a seat element (17, 19);

a back element (23, 25), the seat element and back element being coupled together and the back element being rearwardly tiltably movably supported on the base support;

back pivot means (21) coupling the seat element (17, 19) and the back (23, 25);

spring means (32) coupled to the base support (13, 15) and to the back (23, 25), positioned and arranged for biassing the back forwardly;

and a comfort position memory arrangement including a readily accessible manually adjustable positioning stop arrangement (37, 41) further including a stop element (41) secured to the seat element and coupling said seat element and said back element and permitting backward tilting of the back element against the force of said spring means while inhibiting forward tilting movement of the back element beyond a predetermined tilt position, said comfort position memory arrangement comprising a rotatable cam (37), rotatably secured to said back element and selectively engageable by the stop element (41);

a manual adjustment means (45) coupled to and rotating the cam for positioning said cam at selected angular positions which determine said predetermined tilt positions, including a wheel segment and end abutment stop projections (49) located at end portions of said segment and engageable with the back element (23) to define end positions of rotation of the cam, said cam having a cam rotation axis spaced from and rearwardly of said tilt axis (35) and having a cam surface nonconcentric with said tilt axis and a cam curvature oriented to permit free rearward tilting movement of the back element (23, 25) by disengagement of the stop (41) from the cam surface, while inhibiting forward tilting movement beyond said predetermined position by engagement of the stop (41) with the cam surface of said cam;

wherein said back pivot means (21) is positioned close to a central region of said seat element; and the back element (23, 25) is formed with an opening through which said manual adjustment wheel segment extends.

2. The chair of claim 1, wherein the cam (37) is formed with a serrated surface defining a plurality of teeth (39), and said stop element comprises a pawl (41) engageable with a selected one of said teeth.

3. The chair of claim 1, wherein the spring (32) comprises a manually blockable gas spring (32).

4. The chair of claim 1, further including a link mechanism (21; 29, 31, 33) coupled, respectively, to the seat element (17, 19) and the back element (23, 25) and coupling said elements together for linked, joint movement to form a synchronized seat-back movement arrangement.

* * * * *